US005165869A

United States Patent [19]

Reynolds

[11] Patent Number: 5,165,869

[45] Date of Patent: Nov. 24, 1992

[54] DIAPHRAGM PUMP

[75] Inventor: Steven M. Reynolds, Mansfield, Ohio

[73] Assignee: Warren Rupp, Inc., Mansfield, Ohio

[21] Appl. No.: 833,594

[22] Filed: Feb. 10, 1992

Related U.S. Application Data

[63] Continuation of Ser. No. 644,969, Jan. 16, 1991, abandoned.

[51] Int. Cl.[5] ..... F04B 43/06; F04B 7/08

[52] U.S. Cl. ..... 417/385; 417/413; 417/388

[58] Field of Search ..... 417/395, 385, 386, 387, 417/388, 413

[56] References Cited

U.S. PATENT DOCUMENTS

| | | | |
|---|---|---|---|
| 1,627,257 | 5/1927 | Stevens | 417/63 |
| 2,578,746 | 12/1951 | Scherger et al. | 417/388 |
| 2,713,827 | 7/1955 | Hoop | 417/388 |
| 2,871,789 | 2/1959 | Kiffer et al. | 103/44 |
| 3,000,320 | 9/1961 | Ring | 417/383 |
| 3,030,892 | 4/1962 | Piccardo | 417/395 |
| 3,168,045 | 2/1965 | Sebastiani | 417/383 |
| 3,323,461 | 6/1967 | Bennet | 417/387 |
| 3,680,981 | 8/1972 | Wagner | 417/388 |
| 3,902,826 | 9/1975 | Nagel | 417/388 |
| 4,021,157 | 5/1977 | Elderfield | 417/387 |
| 4,459,089 | 7/1984 | Vincent et al. | 417/383 |
| 4,474,540 | 10/1984 | Bonastia | 417/388 |
| 4,619,589 | 10/1986 | Muller | 417/388 |

OTHER PUBLICATIONS

"Making Small-Scale Additions", Calculation and Shortcut Desk Book (Chemical Engineering), McGraw-Hill, 1992, p.97.

"Centrac" Brochure, Milton Roy Flow Control Division, Oct. 1991.

"Piston and Diaphragm Metering Pumps . . . Basic Design, Application and Maintenance Principles", Peace, Plant Engineering, Oct. 26, 1978, p. 131.

Plant Engineering, Nov. 29, 1979, pp. 58, 60.

*Primary Examiner*—Richard A. Bertsch

*Assistant Examiner*—Peter Korytnyk

*Attorney, Agent, or Firm*—Hill, Van Santen, Steadman & Simpson

[57] ABSTRACT

A piston-driven fluid pump including a drive chamber containing drive fluid and a drive diaphragm forming a wall of the drive chamber. The pump also includes a spill containment chamber disposed adjacent the drive chamber and containing drive fluid, with a pumping diaphragm forming a wall of the spill containment chamber. A pump chamber assembly is disposed adjacent the fluid containment chamber, and is in fluid communication with a source of fluid to be pumped. A selectively actuable piston pressurizes the drive fluid in the drive chamber, and a pressure compensation device, disposed in fluid communication with the drive chamber, provides selectively variable pressure relief to the drive chamber.

24 Claims, 2 Drawing Sheets

DIAPHRAGM PUMP

This is a continuation, of application Ser. No. 644,969, filed Jan. 16, 1991, now abandoned.

TECHNICAL FIELD

The invention is directed to diaphragm pumps generally, and specifically to a double-diaphragm chamber, piston-driven fluid pump including a pressure compensation device.

BACKGROUND OF THE INVENTION

The use of diaphragms in piston-driven fluid pumps is well known. Diaphragm pumps offer several advantages over conventional piston pumps, among which are resistance to leakage and a decrease in the number of parts required. In such pumps, the diaphragms are not driven directly, but are driven through a hydraulic pressure medium or "drive fluid", commonly oil, which is contained within a drive chamber and pressurized by a piston arrangement. The diaphragm forms a boundary between the drive fluid and the fluid to be pumped. In order to provide a safety mechanism against overpressurization of the drive fluid, the drive chamber may be connected to a dump valve, which permits the escape of drive fluid from the drive chamber when the drive fluid exceeds a predetermined maximum pressure.

One disadvantage of known diaphragm pumps is that the drive fluid, through actuation of the dump valve or passage through a cooling mechanism, may be exposed to the ambient atmosphere. This exposure not only increase the risk of contamination of the drive fluid, but permits air to be mixed with the drive fluid. During subsequent operation of the pump, air within the drive fluid causes carbonization or oxidation to occur, which shortens the effective life of the drive fluid, and may cause premature failure of the pump itself.

Another disadvantage of known diaphragm pumps is that, when the dump valve is actuated, pressure within the drive chamber drops to atmospheric pressure. Until drive fluid is restored to the drive chamber, continued operation of the piston results in undesirable cavitation within the pump.

Yet another disadvantage of known diaphragm pumps is the risk of contamination of pump fluid by leaking drive fluid. If the diaphragm seal is defective, or develops a leak due to wear, drive fluid may escape to the pump chamber, where it may commingle with, and contaminate, fluid to be pumped. Such contamination is particularly undesirable in applications where the purity of the fluid to be pumped is critical.

Yet another disadvantage of known diaphragm pumps is that, in most arrangements, the only way to vary the pressure or flow rate of fluid through the pump is to vary the drive speed of the piston. This often means that the motor driving the piston is operated at less-than-optimal efficiency.

Still another disadvantage of known diaphragm pumps is that they tend to provide a pulsating flow of pumped liquid. In order to counteract such pulsation, various damping arrangements have been proposed (see e.g. U.S. Pat. No. 4,459,089 to Vincent et al.). However, known damping arrangements are relatively complex, thus negating some of the inherent advantages of diaphragm pumps.

SUMMARY OF THE INVENTION

It is, therefore, an object of the present invention to provide a diaphragm pump that minimizes the above-mentioned disadvantages, while retaining the benefits of safety and serviceability that make diaphragm pump arrangements desirable.

It is another object of the present invention to provide a diaphragm pump that isolates drive fluid within a closed system, to prevent exposure of the drive fluid to the ambient atmosphere.

It is another object of the present invention to provide a diaphragm pump that prevents pressure within the drive chamber from remaining at atmospheric pressure long enough to cause undesirable cavitation within the pump.

It is another object of the present invention to provide a diaphragm pump that inhibits contamination of pump fluid by leaking drive fluid.

It is another object of the present invention to provide a diaphragm pump in which the pressure or flow rate of fluid through the pump may be selectively varied without varying the speed of the drive mechanism.

It is another object of the present invention to provide a diaphragm pump utilizing a relatively simple, yet effective damping system to lessen the effect of pulsating flow of pumped liquid.

In attainment of the foregoing objects, the present invention overcomes the disadvantages of known pumps by providing a piston-driven fluid pump including a drive chamber and a spill containment chamber disposed adjacent the drive chamber; Each of the chambers contains a predetermined quantity of drive fluid. A pump chamber assembly is disposed adjacent the fluid containment chamber, and is in fluid communication with a source of fluid to be pumped. A selectively actuable piston is used for pressurizing the drive fluid in the drive chamber.

A drive diaphragm forms a wall of the drive chamber, and allows the spill containment chamber to be pressurized in response to actuation of the piston. A pumping diaphragm forms a wall of the spill containment chamber, and affects movement of the pump fluid into and through the pump chamber assembly in response to pressurization of the spill containment chamber by the drive diaphragm.

The drive chamber includes a generally annular sidewall, a first endwall open to the pressurizing piston, and a second endwall defined by the drive diaphragm. The spill containment chamber includes a generally annular sidewall, a first endwall defined by the drive diaphragm, and a second endwall defined by the pumping diaphragm.

The drive chamber and the spill containment chamber may be filled with different drive fluids. For example, the spill containment chamber can be filled with a drive fluid that is compatible with the fluid to be pumped, or an inert fluid. In such an arrangement, in the event of leakage into the pump chamber, detrimental effects of pump fluid contamination would be minimized.

A pressure compensation assembly is in fluid communication with the drive chamber, and provides selectively variable pressure relief to the drive chamber.

The pressure compensation assembly includes a pressure compensation device, which can be provided in the form of an annular housing having a longitudinal bore therethrough. The bore has a first end in fluid communication with the drive chamber, and a second end open to a pressurized source of fluid. A pressure compensation piston is reciprocally mounted within the bore between the first and second ends of the annular housing. If blockage of pump fluid should occur to a degree sufficient to cause drive fluid within the drive chamber to exceed a predetermined maximum pressure, the pressure compensation assembly prevents pressure within the drive chamber from remaining at atmospheric pressure long enough to cause undesirable cavitation within the pump.

A pressure gauge may be provided between the pressure compensation device and the pressurized source of fluid for monitoring fluid pressure in the pressure compensation device, and an adjustable control valve may be provided between the pressure gauge and the pressurized source of fluid in order to control fluid pressure in the pressure compensation device.

The adjustable control valve may be used to vary the pressure or flow rate of fluid through the pump without varying the speed of the drive mechanism.

In an exemplary embodiment, each of a plurality of pistons is provided with a dual-chamber and pressure compensation device arrangement.

Other objects and advantages of the present invention will be apparent upon reference to the accompanying description when taken in conjunction with the following drawings.

DESCRIPTION OF THE PREFERRED EMBODIMENT

Figure 1:
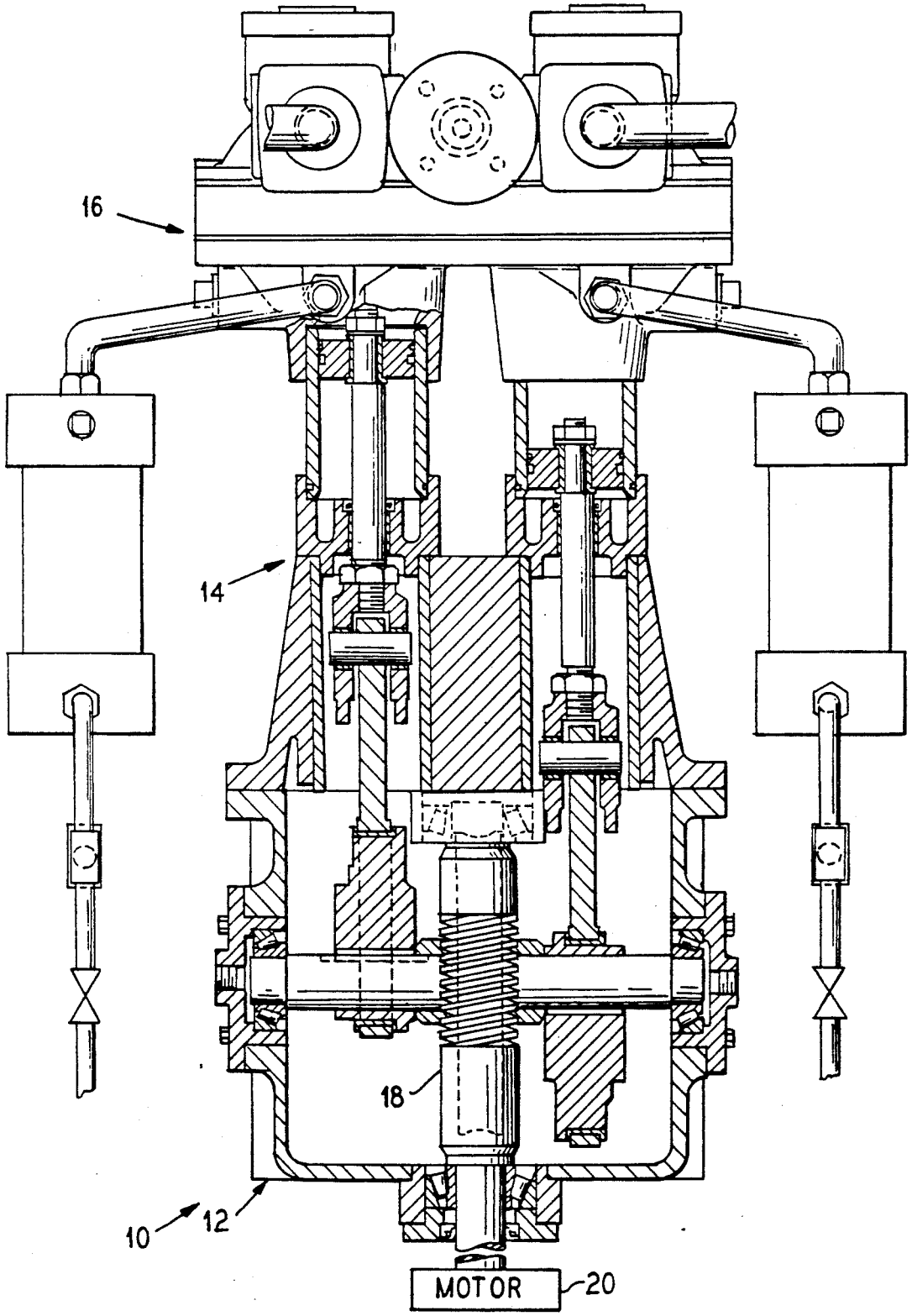
FIG. 1 illustrates a part-sectional view of an embodiment of the present invention as applied to a multiple-piston pump.

A piston driven double diaphragm pump 10 is shown generally at FIG. 1. The pump 10 includes a drive assembly 12, a pair of piston assemblies 14, and a pump head assembly 16.

Figure 2:
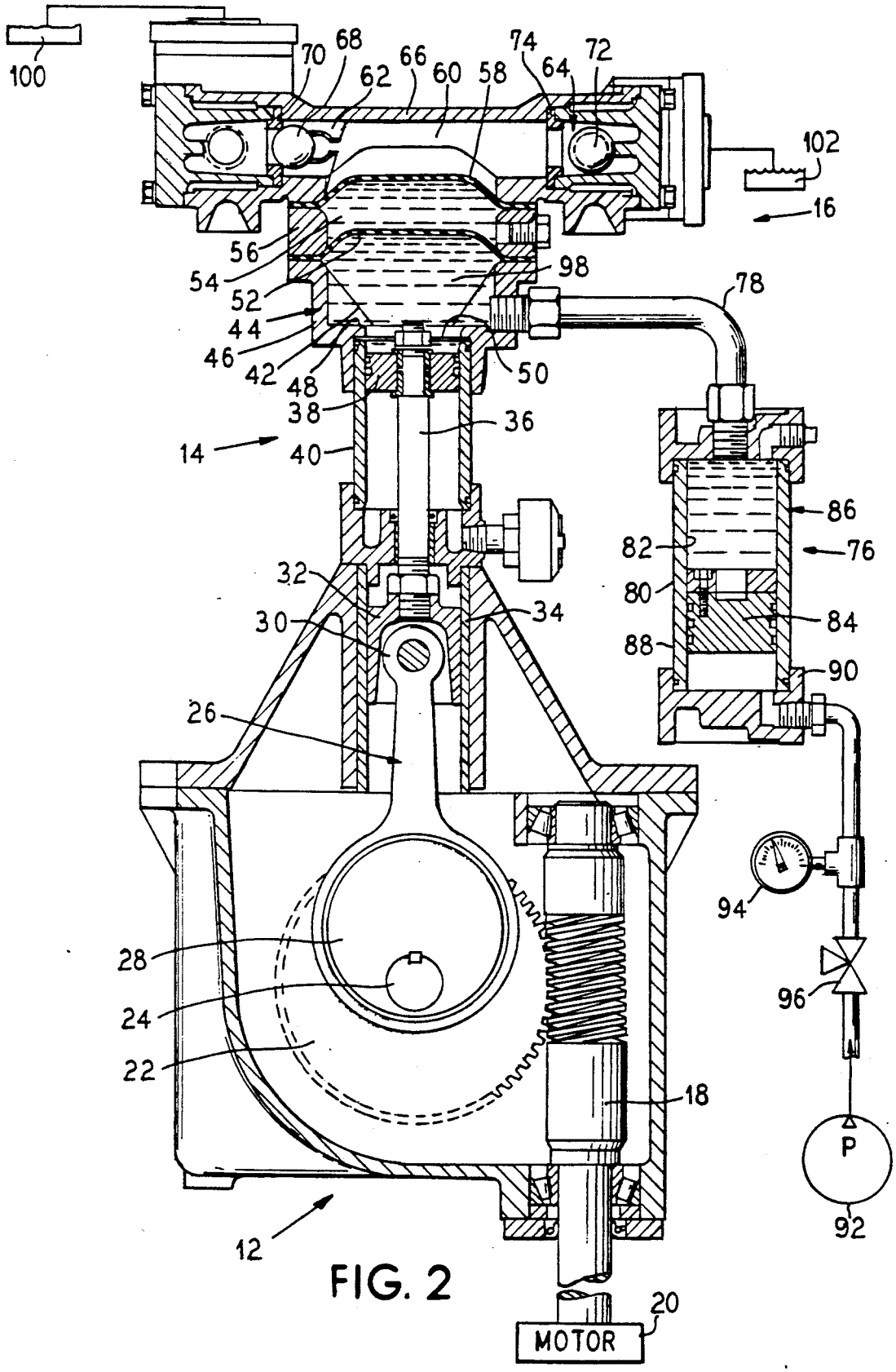
FIG. 2 illustrates a sectional view taken generally along line II-II of FIG. 1.

As shown in detail in FIG. 2, the drive assembly 12 includes a worm gear 18 driven directly by a motor 20. The worm gear 18 is mounted for driving engagement with a toothed drive gear 22, which is keyed to a drive shaft 24. A crank arm 26 has a first end 28 mounted eccentrically on the shaft 24, and a second end 30 pivotally secured to a piston drive coupling 32, which is mounted for reciprocating movement in a drive coupling sleeve 34. The drive coupling 32 provides a driving connection between the drive assembly 12 and the piston assembly 14. As shown in FIG. 2, the piston assemblies are attached to the shaft via respective crank arms that are 180 degrees out of phase with one another, in order to further reduce pulsating flow of pumped fluid.

The piston assembly 14 includes a piston shaft 36 that mechanically connects the drive coupling 32 with a piston 38. The piston 38 is mounted for reciprocation within a piston cylinder 40, and provides the motive force required for operation of the pump head assembly 16.

The pump head assembly 16 includes a drive chamber 42 that is capable of being pressurized by the piston 38. The drive chamber 42 has a casing 44 that defines a generally annular sidewall 46. A first endwall 48 of the drive chamber 42 includes a port 50 that is open to the interior of the piston cylinder 40. A drive diaphragm 52 mounted opposite the port 50 forms a second endwall of the drive chamber 42.

A spill containment chamber 54 includes a casing 56 in the form of a generally annular sidewall. The drive diaphragm 52 forms a first endwall of the spill containment chamber 54. A pumping diaphragm 58 is mounted opposite the drive diaphragm 52, and defines a second endwall of the spill containment chamber 54. In addition to forming an endwall of the spill containment chamber 54, the pumping diaphragm 58 can be pressurized to affect movement of fluid to be pumped into and through a pump chamber assembly 60. The pump chamber assembly 60 includes an inlet valve 62 and an outlet valve 64 mounted within a pump chamber housing 66. The inlet valve 62 includes a valve element 68 mounted for coaction with a valve seat 70. Similarly, the outlet valve 64 includes a valve element 72 mounted for coaction with a valve seat 74.

The pump head assembly head 16 also includes a pressure compensation assembly 76. A conduit 78 provides fluid communication between the pressure compensation assembly 76 and the drive chamber 42. The pressure compensation assembly 76 includes an annular cylinder 80 having a longitudinal bore 82 therethrough. A pressure compensation piston 84 is reciprocally mounted within the cylinder 80, and divides the pressure compensation device into a "wet" side 86 and a "dry" side 88. A pair of end caps 90 close the ends of the cylinder 80. The dry side 88 of the cylinder 80 is in communication with a source of pressurized fluid 92. A pressure gauge 94 can be mounted between the pressure compensation device and the pressurized source of fluid for monitoring fluid pressure in the pressure compensation device, and an adjustable control valve 96 can be provided between the pressure gauge and the pressurized source of fluid in order to control fluid pressure in the pressure compensation device.

The drive chamber 42 and the spill containment chamber 54 are filled respectively with a predetermined quantity of drive fluid 98. It is contemplated that the drive chamber and the spill containment chamber may be filled with different drive fluids. For example, the spill containment chamber can be filled with a drive fluid that is compatible with the fluid to be pumped, or an inert fluid. In such an arrangement, in the event of leakage into the pump chamber, detrimental effects of pump fluid contamination would be minimized.

The conduit 78 permits free flow of drive fluid between the drive chamber 42 and the wet side 86 of the cylinder 80. The control valve 96 can be used to vary the operating pressure of the pressure compensation device 76, and thus provides selectively variable pressure relief through displacement of drive fluid from the drive chamber 42 to the pressure compensation device 76 during operation of the pump. By varying the pressure exerted by the piston on the pumping diaphragm, the adjustable control valve may be used to vary the pressure or flow rate of fluid through the pump without varying the speed of the drive mechanism. It is to be understood that the pressure compensation device described is an exemplary embodiment and that other structure, e.g. a spring with an adjustable abutment, could be used to impart biasing force to the pressure compensation piston 84. It is also contemplated that a pistonless pressure compensation device, such as a diaphragm arrangement, could alternatively be employed.

During operation of the pump, the motor 20 is used to drive the worm gear 18, which in turn causes the drive gear 22 to impart rotation to the shaft 24. Rotation of the shaft 24 causes eccentric rotation of the crank arm 26, which results in reciprocation of the piston 38. During downstroke of the piston 38, pressure within the drive chamber 42 causes downward deflection of the drive diaphragm 52 and the pumping diaphragm 58 thus creating negative pressure within the pump chamber 60. This negative pressure forces the outlet valve element 72 to seat on its valve seat 74, and lifts the inlet valve element 68 off of its valve seat 70, thus causing the fluid to be pumped to flow from a source 100 into the pump chamber 60.

On the upstroke of the piston 38, the drive diaphragm 52 and the pumping diaphragm 58 exert a positive pressure within the pump chamber 60 to force the inlet valve element 68 to seat while lifting the outlet valve element 72 from its seat, and cause pump fluid to flow from the pump chamber 60 to a pump fluid destination 102.

The dual chamber arrangement hydraulically actuates the pumping diaphragm 58, and provides hydraulic balance while eliminating diaphragm stress. Pressure relief levels are set by charging the dry side of the pressure compensation device to a desired pressure level with, for example, compressed air or nitrogen. As mentioned hereinabove, the pressure compensation device 76 also provides pulsation dampening. The construction of the pump head assembly 16 offers flexibility in application, in addition to providing externally serviceable and accessible inlet and outlet valve assemblies. The dual-chamber arrangement, in conjunction with the pressure compensation assembly, provides an entirely closed system in which drive fluid is contained, thus minimizing the risk of drive fluid contamination. The pressure compensation assembly, when operated with a control valve, be used to vary the pressure or flow rate of fluid through the pump without varying the speed of the drive mechanism.

Although the present invention has been described with reference to a specific embodiment operating in accordance with certain physical principles, those of skill in the art will recognize that changes may be made thereto without departing from the scope and spirit of the invention as set forth in the appended claims, and that alternative embodiments, operating in accordance with either similar or dissimilar physical principles, are contemplated as falling within the scope and spirit of the invention as set forth in the appended claims.

I claim as my invention:

1. A piston-driven fluid pump comprising:

a drive chamber containing drive fluid and including a drive diaphragm forming a wall of said drive chamber;

a spill containment chamber sharing said wall of said drive chamber and containing drive fluid and including a pumping diaphragm forming a further wall of said spill containment chamber;

a pump chamber assembly sharing said further wall of said spill containment chamber and connectable to be in fluid communication with a source of flowable material to be pumped;

reciprocating constant speed piston means disposed for interacting with said drive fluid in said drive chamber for pressurizing said drive fluid in said drive chamber and in said spill containment chamber for causing throughput in said pump chamber assembly of said material to be pumped; and pressure adjustment means, in fluid communication with said drive chamber, for selectively increasing or decreasing pressure acting on said drive fluid in said drive chamber to correspondingly decrease or increase said throughput independently of the reciprocation speed of said piston means.

2. A fluid pump according to claim 1, wherein said drive chamber comprises a generally annular sidewall disposed between said piston means and said drive diaphragm.

3. A fluid pump according to claim 2, wherein said spill containment chamber comprises a generally annular sidewall disposed between said drive diaphragm and said pumping diaphragm.

4. A fluid pump according to claim 1, wherein said pressure adjustment means comprises:

an annular cylinder having a longitudinal bore therethrough, said bore having a first end in fluid communication with said drive chamber, and a second end open to a pressurized source of fluid;

a conduit providing said fluid communication between said first end of said cylinder and said drive chamber; and a pressure adjustment piston reciprocally mounted within said bore between said first and second ends of said annular cylinder.

5. A fluid pump according to claim 4, further comprising pressure gauge means, disposed between said pressure compensation device and said pressurized source of fluid, for monitoring fluid pressure in said pressure compensation device.

6. A fluid pump according to claim 5, further comprising an adjustable control valve disposed between said pressure gauge means and said pressurized source of fluid.

7. A fluid pump as claimed in claim 1 wherein said drive diaphragm is planar.

8. A fluid pump as claimed in claim 1 wherein said pumping diaphragm is planar.

9. A fluid pump as claimed in claim 1 wherein said drive diaphragm and said pumping diaphragm are planar.

10. A fluid pump as claimed in claim 1 wherein said drive fluid is liquid.

11. A piston-driven fluid pump comprising:

a pump chamber assembly connectable to be in fluid communication with a source of flowable material to be pumped, said pump chamber assembly containing a flexible wall disposed to interact with said flowable material;

pressurizable means containing liquid drive fluid and disposed adjacent said pump chamber assembly and sharing said flexible wall thereof;

reciprocating constant speed piston means disposed for interacting with said liquid drive fluid in said pressurizable means to displace said flexible wall and thereby cause throughput in said pump chamber assembly of said material to be pumped; and pressure adjustment means, in fluid communication with said pressurizable means, for selectively increasing or decreasing the amount of pressure acting on said liquid drive fluid in said pressurizable means to correspondingly alter displacement of said flexible wall to decrease or increase said throughput independently of the reciprocation speed of said piston means.

12. A fluid pump as claimed in claim 11 wherein said pressure adjustment means comprises:

an annular cylinder having a longitudinal bore therethrough, said bore having a first end in fluid communication with said drive chamber, and a second end open to a pressurized source of fluid;

a conduit providing said fluid communication between said first end of said cylinder and said pressurizable means; and a pressure adjustment piston reciprocally mounted within said bore between said first and second ends of said annular cylinder.

13. A fluid pump according to claim 12 further comprising pressure gauge means, disposed between said pressure adjustment means and said pressurized source of fluid, for monitoring fluid pressure in said pressure adjustment means.

14. A fluid pump as claimed in claim 13, further comprising an adjustable control valve disposed between said pressure gauge means and said pressurized source of fluid.

15. A piston-drive fluid pump comprising:

a drive chamber containing drive fluid;

a spill containment chamber disposed adjacent said drive chamber and containing drive fluid;

a pump chamber assembly disposed adjacent said spill containment chamber, said pump chamber assembly connectable to be in fluid communication with a source of flowable material to be pumped;

drive diaphragm means forming a substantially planar end wall shared by said drive chamber and said spill containment chamber for pressurizing said drive fluid in said spill containment chamber in response to pressurization of said drive fluid in said drive chamber;

pumping diaphragm means forming a substantially planar end wall of said spill containment chamber and disposed for interacting with said material in said pump chamber assembly for causing throughput in said pump chamber assembly of said material;

reciprocating constant speed piston means disposed adjacent said drive chamber for pressurizing said drive fluid in said drive chamber and thereby also pressurizing said drive fluid in said spill containment chamber for causing said throughput of said material;

a pressure adjustment cylinder having a pressure adjustment piston reciprocally mounted therein, said pressure adjustment cylinder containing drive fluid and having a first end in fluid communication with said drive chamber;

a source of pressurized adjustment fluid in fluid communication with an opposite end of said pressure adjustment cylinder for displacing said pressure adjustment piston in said pressure adjustment cylinder; and means for selectively setting a flow of said pressure adjustment fluid to said pressure adjustment cylinder to selectively increasing or decreasing pressure acting on said drive fluid in said drive chamber to correspondingly decrease or increase said throughput independently of the reciprocation speed of said piston means.

16. A fluid pump as claimed in claim 15 wherein said drive fluid is liquid.

17. A piston-drive fluid pump comprising:

a pump chamber assembly connectable to be in fluid communication with a source of flowable material to be pumped;

a plurality of pumping assemblies, each pumping assembly including a drive chamber containing drive fluid, a spill containment chamber containing drive fluid disposed adjacent said drive chamber, a drive diaphragm forming a common wall between said drive chamber and said spill containment chamber, a pumping diaphragm forming a further wall of said spill containment chamber and disposed in said pump chamber assembly for interacting with said material to be pumped, and reciprocating piston means disposed for interacting with said drive fluid in said drive chamber for pressurizing said drive fluid in said drive chamber and in said spill containment chamber to displace said pumping diaphragm for causing throughput in said pump chamber assembly of said material;

drive constant speed means connected to each piston means in the respective pumping assemblies for driving the respective piston means in a sequence constant speed for displacing the respective pumping diaphragms to cause uniform throughput of said material in said pump chamber assembly; and each pumping assembly having pressure adjustment means connected thereto, in fluid communication with said drive chamber, for selectively increasing or decreasing pressure acting on said drive fluid in said drive chamber to correspondingly decrease or increase said throughput independently of the reciprocation speed of said piston means.

18. A fluid pump as claimed in claim 17 wherein said pressure adjustment means comprises:

an annular cylinder having a longitudinal bore therethrough, said bore having a first end in fluid communication with said drive chamber, and a second end open to a pressurized source of fluid;

a conduit providing said fluid communication between said first end of said cylinder and said pressurizable means; and a pressure adjustment piston reciprocally mounted within said bore between said first and second ends of said annular cylinder.

19. A fluid pump according to claim 18 further comprising pressure gauge means, disposed between said pressure adjustment means and said pressurized source of fluid, for monitoring fluid pressure in said pressure adjustment means.

20. A fluid pump as claimed in claim 19, further comprising an adjustable control valve disposed between said pressure gauge means and said pressurized source of fluid.

21. A fluid pump as claimed in claim 19 wherein said drive fluid is liquid.

22. A fluid pump as claimed in claim 19 wherein said drive diaphragm is planar.

23. A fluid pump as claimed in claim 17 wherein said pumping diaphragm is planar.

24. A fluid pump as claimed in claim 17 wherein said drive diaphragm and said pumping diaphragm are planar.

* * * * *